US007323648B1

(12) United States Patent
Palombi

(10) Patent No.: US 7,323,648 B1
(45) Date of Patent: Jan. 29, 2008

(54) DOUBLE ACTION ACTIVATED SWITCH

(76) Inventor: Carlo Aldo Palombi, 64 duran Dr., San Rafael, CA (US) 94903

( * ) Notice: Subject to any disclaimer, the term of this patent is extended or adjusted under 35 U.S.C. 154(b) by 0 days.

(21) Appl. No.: 11/375,863

(22) Filed: Mar. 14, 2006

Related U.S. Application Data

(60) Provisional application No. 60/735,014, filed on Nov. 10, 2005.

(51) Int. Cl.
*G07F 11/00* (2006.01)

(52) U.S. Cl. ..... 200/52 R; 194/239

(58) Field of Classification Search ..... 200/43.01–22, 200/52 R, 61.41, 61.42, 61.59, 58 R; 194/317, 194/351, 239, 344, 203
See application file for complete search history.

(56) References Cited

U.S. PATENT DOCUMENTS

| | | | | |
|---|---|---|---|---|
| 4,509,630 | A * | 4/1985 | Mongelli | 194/343 |
| 5,303,808 | A * | 4/1994 | Hiortdahl | 194/202 |
| 5,381,880 | A * | 1/1995 | Pearson | 194/217 |
| 6,062,370 | A * | 5/2000 | Nikolayev et al. | 194/219 |
| 2004/0112730 | A1 * | 6/2004 | Blossfeld | 200/284 |

FOREIGN PATENT DOCUMENTS

WO WO 2003030111 A2 * 4/2003

* cited by examiner

*Primary Examiner*—Elvin Enad
*Assistant Examiner*—M. Fishman

(57) ABSTRACT

A new rotary switch and new rotary switch assembly kit which has two normally open terminals and two normally closed terminals outside the surface of the switch, and also has two arm actuate steel wires and two separate electric circuits to be used in association with coin drop units that operate coin machines and similar equipment, comprising a new rotary switch and a new rotary switch assembly kit having one common terminal and two arm actuate steel wires and two separate electric circuits in an open position, which when activated by a coin will complete the electrical circuit. The new rotary switch and the assembly kit are generally installed at the bottom of the coin drop units with the two actuate arm steel wires spread apart to accommodate any size of coins or tokens with each actuate arm steel wire that has its own open and closed electric circuit such that when a coin strikes the two actuate arm steel wires simultaneously it will close both electric circuits simultaneously in order to operate coin machines and similar equipment, and also can provide different functions that can be used in association with different components of electric, electronic and mechanical machines and equipment.

11 Claims, 5 Drawing Sheets

DOUBLE ACTION ACTIVATED SWITCH

This application claims the benefit of the U.S. Provisional Application No. 60/735,014, filed Nov. 10, 2005.

BACKGROUND OF THE INVENTION

1. Field of the Invention

The present invention relates to a Double Action Activated Switch and more particularly to a new miniature side rotary new switch that has one com terminal two actuate arm steel wires and two separate electric circuit. Also, by adding a new switch to another switch in series, for this purpose, it will provide a double wireform actuator assembly kit switch. This will eliminate the possibility of using a wire, or any similar devices, to start any machines or equipment which use coin drop units to operate machines for free. This Double Action Activated Switch can provide for different functions that can be used in association with different components of electric, electronic and mechanical machines and equipment.

2. Description of the Prior Art

The use of side rotary miniature of wire switches is known in the prior art. More specifically, miniature side rotary switches devised and utilized are known to consist basically of customary, predictable and palpable structural configurations, notwithstanding the myriad of designs encompassed by the prior art, which have been developed for the implementation of numerous objectives and requirements. Known prior art miniature side rotary switches U.S. Pat. No.

U.S. Pat. No. 3,519,775. July 1970.

U.S. Pat. No. 3,792,206. February 1974.

U.S. Pat. No. 4,571,824. February 1986.

U.S. Pat. No. 4,508,399. April 1985.

U.S. Pat. No. 4,975,548. December 1990.

U.S. Pat. No. 6,984,796.

International Application Under Patent Cooperation Treaty (PCT)

(11) WO 03/030111; (13) A2; (21) PCT/USO2/30890

(22) 26 Sep. 2002 (26.09.2002)

(25) English; (26) English; (30) 09/967,424;

English 28 Sep. 2001 U.S. (28.09.2001)

While these devices fulfill their relevant, specific objectives and requirements, the aforementioned patents do not disclose a new Double Action Activated Switch.

The inventive device includes a new miniature side rotary switch that has a double actuator wire spread part to accommodate any coins or tokens of any size to be used in association with coin drop assembly units, which operate any machines or equipment that require coins or tokens of any size in order to start and operate any machines or similar equipment.

The present invention provides for extra protection to prior art of coin drop units. The present invention is for the purpose of eliminating the idea or ability to use a wire, or similar device, in order to operate machines or equipments, which use coins or token drop assembly units. In this respect, the Double Action Activated Switch, according to the present invention, substantially departs from the conventional concepts and designs of the prior art.

In so doing, it provides an apparatus primarily developed for the purposes of prevention and deterrence for any individual who may use a wire or similar device to operate any machines or equipment, which require the use of coins or tokens in drop assembly units, for free.

SUMMARY OF THE INVENTION

In view of the abovementioned disadvantages inherent in the known types of miniature side rotary switches now present in the prior art, the present invention provides a new side rotary switch construction wherein the same can be utilized to provide a new switch that has two steel wire actuators far apart to accommodate any size of coins or tokens that can be installed on all the present coin drop units of prior art known today, as well as future coin drop units required to operate machines or similar equipment.

The general purpose of the present invention, which will be described below in great detail, is to provide a new Double Action Activated Switch, which is a new method and which has many of the advantages of the miniature side rotary switches mentioned heretofore. Further many innovative features that result in a new Double Action Activated Switch is not probable, rendered evident, suggested or even implied by any of the prior art of rotary actuate wire switches, either alone or in any combination thereof.

Construction of the new rotary switch has two norm. open terminals and two norm. closed terminals outside the switch. The com. terminals are inside of the side rotary switch with one terminal outside, which are provided by the contacts inside the rotary switch.

To attain this, the present invention generally comprises of a side rotary switch, that has one com terminal, two NO and two NC TERMINALS outside the switch. It also has two actuated arm steel wires and two separated electric circuits to be used in association with coin drop units that operate coin operated machines or coin operated equipment that are in need coins or tokens of all sizes in order to start the function of said machines or similar equipments.

Also, the present invention will provide a quick solution: a side rotary switch assembly kit placed in new bracket with all the necessary parts can be installed on coin drop units. There has accordingly been outlined, rather generally, the more important features of the present invention and that this detailed description may better be understood in order that the present contribution of the prior art may be better appreciated.

There are additional features of the present invention that will be described and which will form the subject matter of the claims appended thereto.

In this respect, before explaining at least one of the embodiments of the invention in detail, it is to be understood that the present invention is not limited in its application to the details of construction and to the arrangements of the components set forth in the following description or as illustrated in the drawings.

The present invention is capable of other embodiments and of being practiced and carried out in various ways. Also, it is to be understood that the phrasing and terms engaged are for the purpose of description and should not be regarded as limiting.

As such, those accomplished in the trade will appreciate that the conception, upon which this application is based, may readily be utilized as the basis for the designing of other structures, methods and the systems for carrying out the several purposes of the present invention.

It is important, therefore, that the claims be regarded as including such equivalent construction insofar as they do not depart from the spirit and the scope of the present invention.

Further, the purpose of the abovementioned synopsis is to enable the U.S. Patent and Trademark Office and public generally, and especially the scientist, engineers and practitioners, in the skill, who are not familiar with patent terms or phrases, to determine quickly from a cursory inspection the nature an essence of the technical disclosure of the Application. The summary is neither intended to define the invention of the Application, which is measured by the claims nor is it intended to be limiting as to the scope of the invention in any way.

OBJECTS OF THE INVENTION

Object 1 of the present invention is to provide a single rotary switch one com terminal that has two separate circuits and two arms actuate steel wires, which can provide one electric circuit in a normal closed position, and the other electric circuit in an open normal position, which provides one electric circuit to come on and the other electric circuit to go off simultaneously when struck by an object, which can be used in association with electric, electronic and mechanical components of equipment and machinery.

Object 2 of the present invention is to provide a new switch and a new switch kit assembly, that is easily and efficiently manufactured and marketed.

Object 3 of the present invention is to provide a new switch and a new switch kit assembly, which is of durable and reliable construction.

Object 4 of the present invention is to provide low cost manufacture with regard to both materials and labor, and which accordingly is then inclined to be a lower price of sale to the consuming public, thereby making such Double Action Activated Switch and switch kits assembly economically available to the buying public/consumers.

Object 5 of the present invention is to provide in the apparatus and methods of the prior art some of the advantages thereof, while concurrently overcoming some of the disadvantages normally associated therewith.

Object 6 of the present invention is to provide a safe measure deterring anyone from attaining free operation of any machines or equipments that require coin drop units or token drop units by inserting a wire inside the coin slot of a drop unit, thus attaining free coin operation of laundry machines and other machines or equipment requiring the use of coin drop units.

Object 7 of the present invention is to provide a new Double Action Activated Switch that can be used in future coin drop units to start coin operated laundry machines and other equipments that require coin drop units operation—so that when the coin drops in the channel of the coin unit, the two actuate steel wires will activate by the coin and strike at the same time to complete the electrical circuit in order to start any equipment that requires coin drop units, including but not limited to slot machines, car wash places, parking meters, telephones, soda and food machines, laundry equipment, etc. . . .

Object 8 of the present invention is to provide a new Double Action Activated Switch that can be used in many different ways, one of which is to prevent fraud of the present coin drop units, which are used in commercial laundry machines and similar equipments provided by a new rotary switch that has double arm steel wires with two separated on and off electrical circuits with a coin adjustable gap between the arm steel wires to accommodate any different sizes of coins to strike the two wires simultaneously and completed the electrical circuits to operate coins laundry machines or other equipments that use coin drop units and can be installed on the present coin drop units as well as future coin drop units.

Object 9 of the present invention is that there may be other electrical, electronics or mechanical equipment that could use the new invention because of the unique adjustable gap of the two arm steel wires and the two separated electrical circuits that provide on and off simultaneously to complete the electrical circuits and operate many different equipments and components of the machines.

Object 10 of the present invention is to provide a new rotary switch and a new rotary switch kit that can be installed in series with coin photo switch systems or any other coin switch systems of the existing coin drop units and future coin drop units.

Object 11 of the present invention is to provide a new double action activated switch to be install in coin drop units, which has one (COM) terminal, two separated electric circuits, two (NO) terminals, two-(NC) terminals, two actuated arm steel wires that can provide different heights and different gap, also can provide two electric circuits, that can be connected both in a norm. open position, that when the two actuate arm steel wires are strike by a coin or a token both electric circuits will closed simultaneously in order to starts the function of coin operated machines or similar coin operated equipments.

All the above noted objects together with other objects of the invention, along with various features of the novelty which characterize the invention, are pointed out with particularity in the claims annexed to and forming a part of this discovery. For a better understanding of the invention, its operating advantages and the specific objects attained by its uses reference should be made to the accompanying drawings and descriptive matter in which there are illustrated preferred image of the present invention.

BRIEF DESCRIPTION OF THE DRAWINGS

The invention will be better understood and objects other than those set forth above will become apparent when consideration is given to the following detailed description. Such description makes reference to the annexed drawings.

DESCRIPTION OF THE CHOSEN MODEL

Figure 1:
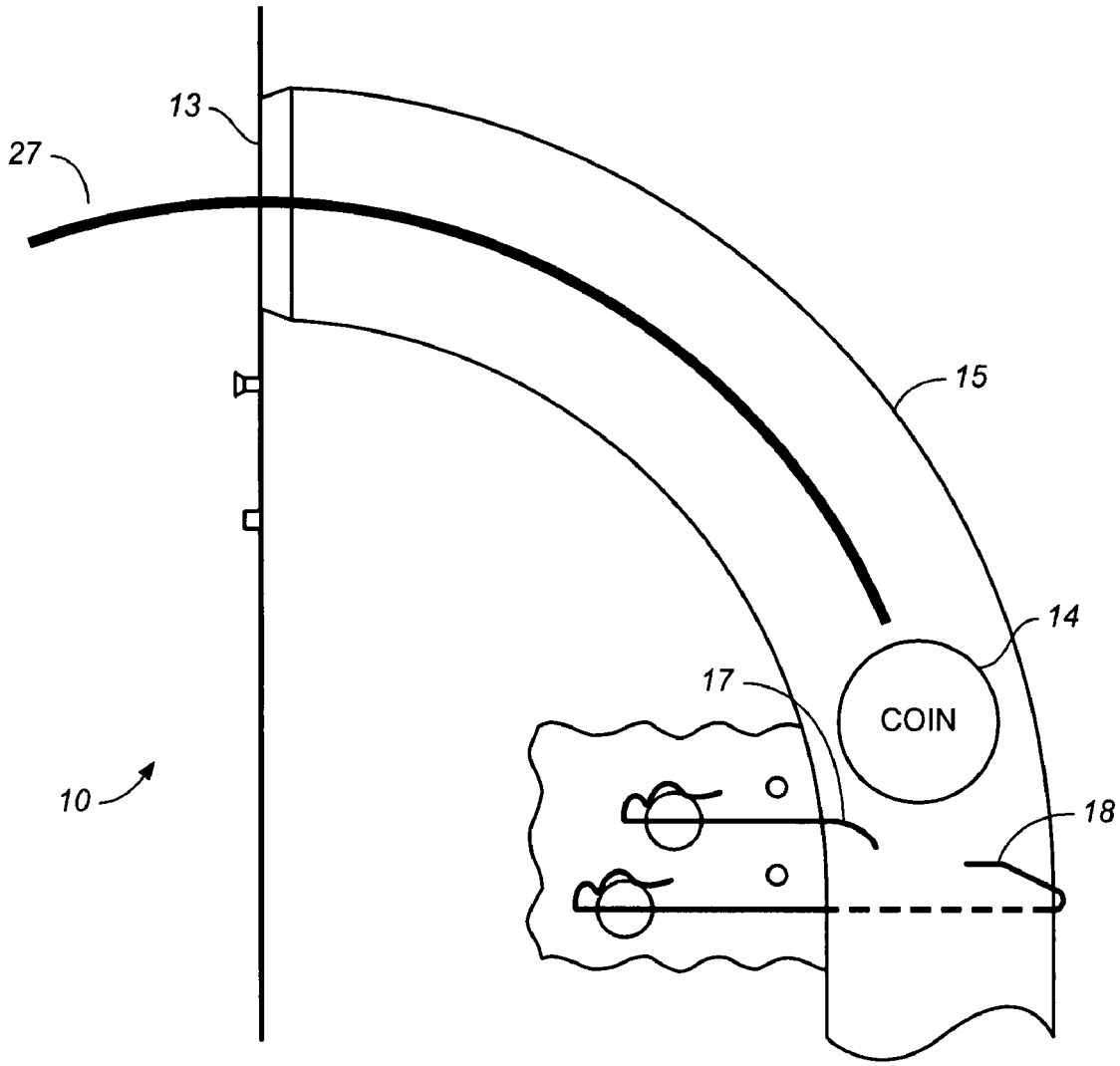
FIG. 1 is a back and side view of the prior art coin unit channel with inside elements of the new rotary switch.
Figure 2:
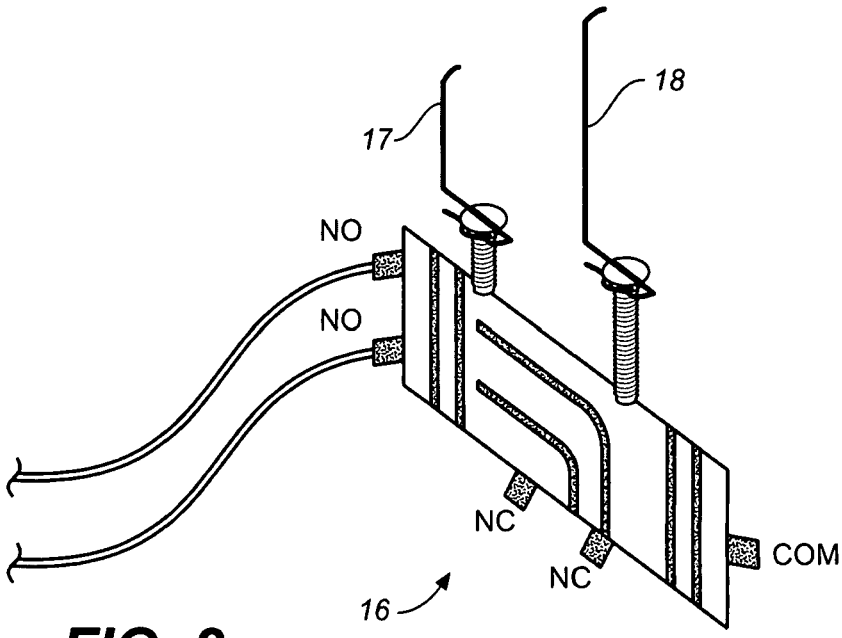
FIG. 2 is top and side of the new rotary switch.
Figure 3:
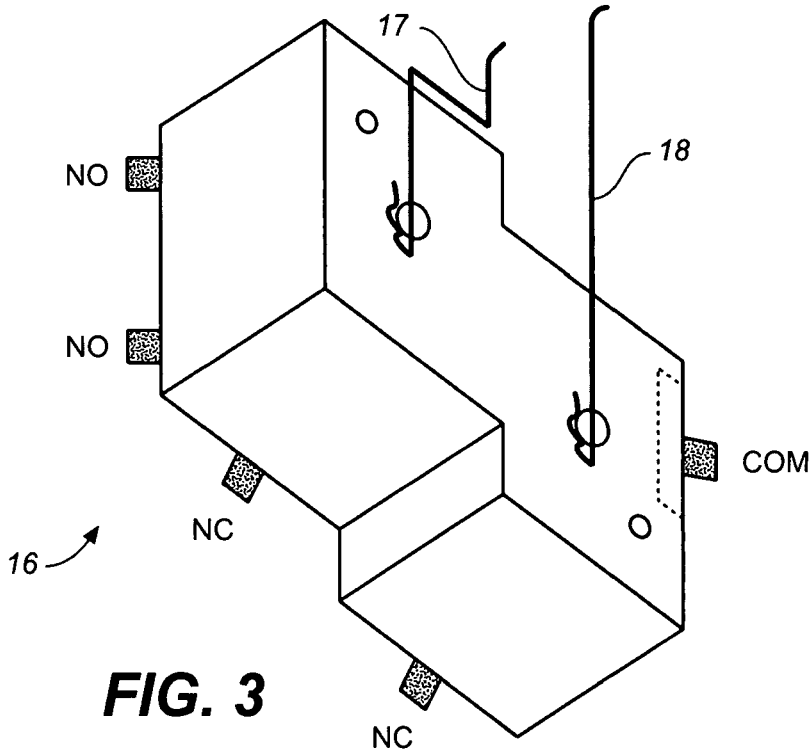
FIG. 3 is a top and side view of the present invention.
Figure 4:
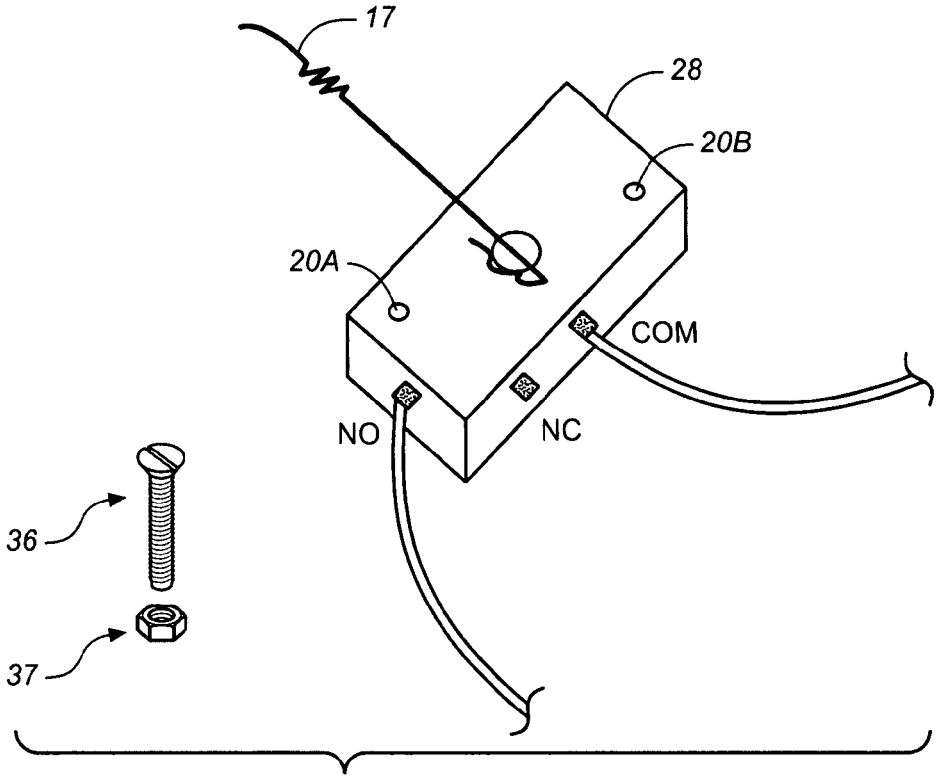
FIG. 4 is top, front, left side view of the prior art switch.
Figure 5:
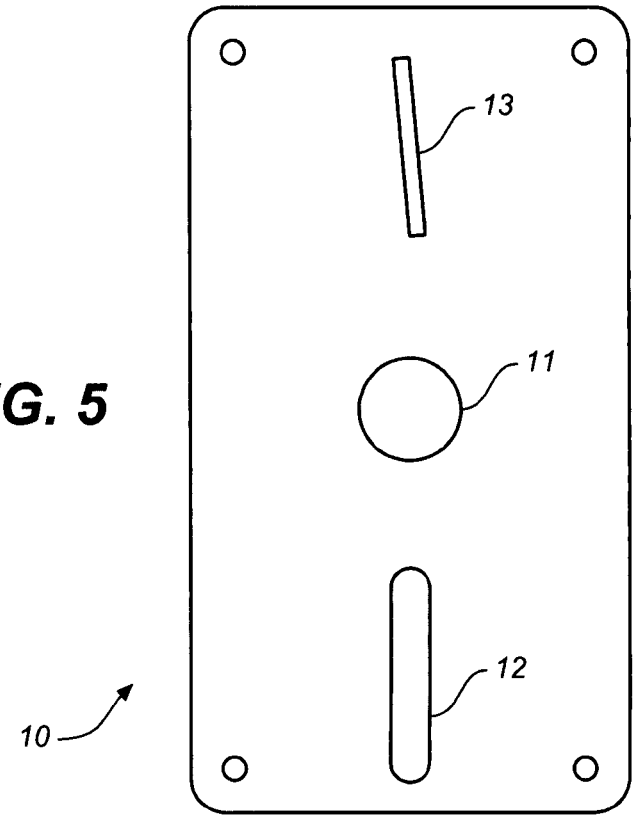
FIG. 5 is a top, front view of a quarter coin unit of the prior art.
Figure 6A:
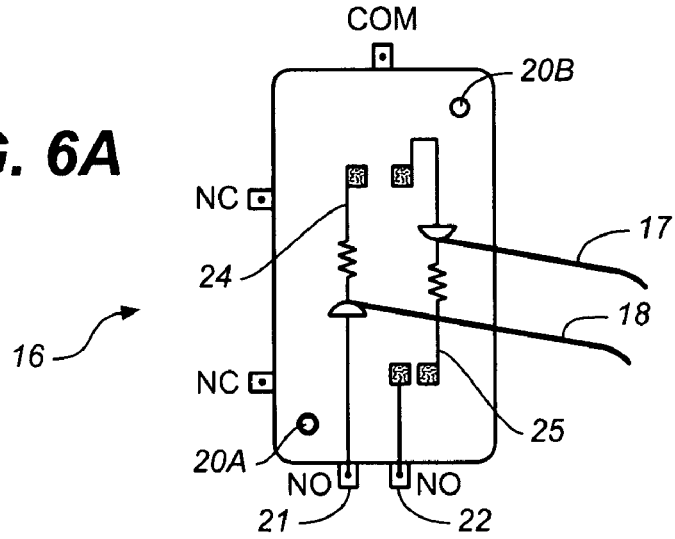
FIG. 6A is a schematic view of the new rotary switch according to the present invention.
Figure 6B:
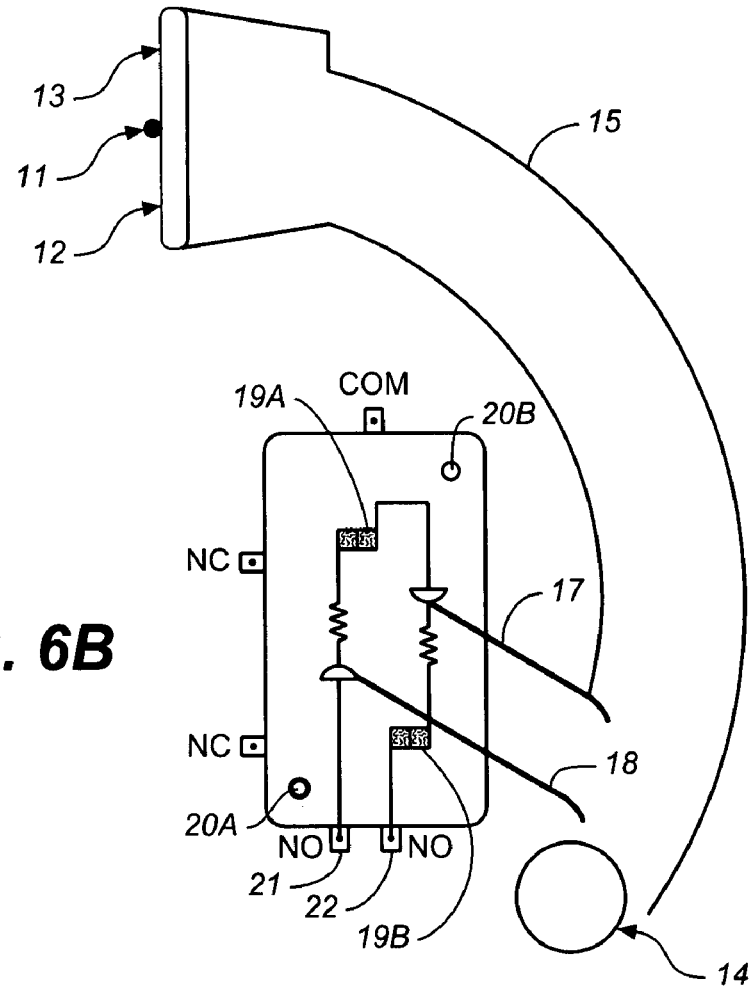
FIG. 6B is a schematic view of the new rotary switch as installed in a coin drop.
Figure 7:
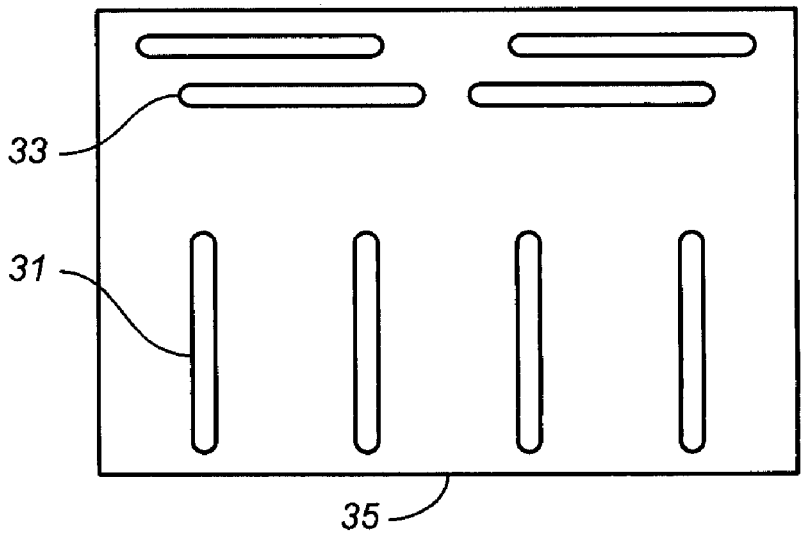
FIG. 7 is top view adj. slots holes, the new switch bracket.

With reference to the drawings, and in particular to FIGS. 1 through 8 of the new Double Action Activated Switch declaring the principles and concepts of the present invention and generally designated by reference, numeral 16 will be described. As best illustrated in FIGS. 1 through 8, the switch 16 generally comprises with a coin drop unit 10, terminal 21 and 22, an electric circuits, wires, contacts 19*ab*, holes 20*ab*, actuated steel wires 17 and 18, coin slot 13, release button 11, coin return 12, coin 14, coin drop channel 15, open position electrical circuit 24 and open position circuit 25.

The new Double Action Activated Switch 16 is generally installed on the bottom of coin drop unit 10.

The new switch 16 provides two separated electrical circuits 41 in the open position 24 and 25. When a person inserts a coin 14 in a coin slot 13, the coin 14 travels through coin drop channel 15 and strikes actuate steel wires 17 and 18 simultaneously, the contacts 19*a* and 19*b* will close the electrical circuit 24 and 25 and it will be able to operate machines 50 and similar equipment 51 that requires coin drop units 10.

Preferably coin laundry machines 50 or similar coin equipment 51 will use this new rotary switch 16 to provide a coin of different sizes of gap between the actuate steel wire 17 and the actuate steel wire 18. Each actuate steel wire 17 and 18 have its own open and closed electrical circuit 41. Therefore providing two separate electrical circuits in norm. open position 24 and norm. open position 25. This new feature along with other features will prevent any kind of fraud, especially these people that insert bra steel curved wire 27 into slot 13 and enter the channel 15 to strike the single actuate steel wire of the rotary switch 28 of the coin drop unit 10, for the purpose to attain free operation of coin machines 50 and similar coin equipment 51 of the prior art 29.

This new rotary switch 16, can also be used in so many other applications, such as in electrical, electronic, or mechanical equipment. This new rotary switch 16 provides new conceptions, methods and principles, that can also be attained by providing a new switch kit assembly 30 that can be made from two rotary switches 28 of numerals 32 and 34, a new bracket 35, screws 36, nuts 37, spaces 38, electric wires 39 and wire nuts 40, with the instruction sheet.

With reference now to drawings of FIGS. 1 through 8, a new switch kit assembly 30 modeling the principles and the concepts of the present invention and generally designated by reference numerals 32 and 34 will be described.

As best illustrated in FIGS. 1 through 8, the switch kit assembly 30 generally comprises with a coin drop unit 10, terminals 21 and 22 wires electrical circuits, contacts 19*a* and 19*b*, holes 20*a* and 20*b*, actuated steel wires 17 and 18, coin slot 13, release button 11 coin 14, coin drop channel 15, new bracket 35, screws 36, nuts 37, spaces 38, electric wires 39, wire nuts 40, open electrical circuits 41, closed electrical circuits 42, witches 32 and 34 combined together to create a new switch kit assembly 30, that can be installed on coin drop units of the prior art 29 and because of the unique adjustable slots 31, 33 of the bracket 35, which makes possible to accommodate the installation of many different types of coin drop units 10 of the prior art 29, by providing different sizes of actuate steel wires 17 and 18 gap, that can accommodate any size of coins, which is used in coin drop units 10 to operate machines 50, similar equipments 51.

According to the present invention of the switch kit assembly 30, it will provide new methods and new concepts for the coin drop units 10 that is used in current day machines 50 and similar coin equipment 51.

The present invention stops and prevents frauds of attaining free operation of machines 50 and similar equipment 51 and also provides a quick solution to the present problems of attaining free operations of coin machines 50 or similar coin equipment 51.

Figure 8:
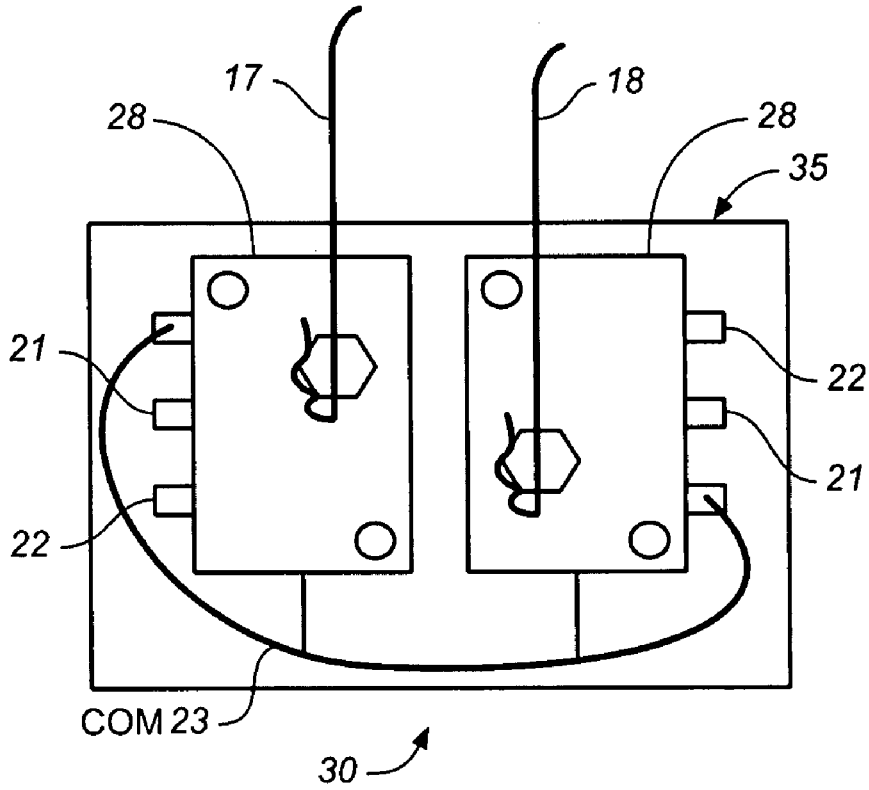
FIG. 8 is top view of the new assembly kit switch of the present invention.

As shown in FIGS. 1 through 8, or preferably FIG. 8 where it shows a completed switch assembly kit 30 that is made of new support adjustable slots 31, and 33 that is provided on the new bracket 35, also noting two switch 28 installed on the new bracket 35 with a jump wire 23 that connects the two com. terminals 22 for the purpose of providing a new switch assembly kit 30 that will have two actuate steel wires 17 and 18 with a gap to accommodate any size of coins or tokens 14.

It also provides two separated electrical circuits in an open position 24 and 25. There are 3 inches of wire leads soldered to nor. open terminals 21 and wires nuts 40 to accommodated more coin drops units 10 that is used in coin operated machines 50 and similar equipment 51.

This new switch assembly kit 30 can easily be installed in many of the coin drop units 10 of the prior art 29 by first removing the single actuate steel wire switch 28 then install the new switch assembly kit 30 on the coin drop unit 10 where the other switch 28 was; then strip the two wires leads and connect the two leads one on each wire of the new switch assembly kit 30.

Methods and function of the switch assembly kit 30: When a person inserts a coin 14 in a coin slot 13, the coin 14 travels through the coin drop channel 15 and strikes actuate steel wires 17 and 18 simultaneously. The contacts 19*a* and 19*b* will close the electric circuits 24 and the electrical circuit 25 and in doing so it will be able to operate machines 50 and similar equipments 51. This provides a quick solution and extra protection to new or used coin drop units 10 to operate coin machines 50 or similar coin equipments 51 and will prevent people from using a curved steel wire 27 or similar tools, that can go inside slot 13 of coin drop units to attain free oration of coin machines 50 or equipment 51.

The invention is capable of other embodiments and can be carried out in various ways. Preferably, it can also be installed on coin drop units 10, which operates coin machines 50 and equipments 51, that use photo switch system 44 and other similar system 45 of the prior art 29 and future art 48 by cutting one wire lead 46 from photo switch system 44 and install one wire lead 46 to switch assembly kit 30 to terminal wire 21 of open circuit switch 24, and install the other wire lead 46 to switch assembly kit 30 to terminal wire 21 of the open circuit 25, which will be used in coin drop units 10 to operate coin machines 50 or equipment 51 of the prior art 29 and future art of the coin drop units.

In doing this, the new switch 16, or the switch assembly kit 30 will provide an extra protection to new or used coin drop units 10, that use coin photo switch system 44 or other similar coin switch system 45 to operate coin machines 50 or equipment 51. This in turn provides a quick solution and extra protection to new or used coins drop units 10 and will prevent people from using a steel curved bra 2 wire 27 or similar tools that can be inserted inside slots 13 of coin drop units 10 and attain free operations of present and future coin operate machines 50 and equipment 51.

As further discussion of the manner of usage and operation of the present invention, the same should be apparent from the above description. Accordingly, no further discussion relating to the manner of usage and operation will be provided.

With respect to the above description, then it is to be realized that the optimum dimensional relationship for the parts of the invention, to include variation in size, materials, shapes, form, function and manner of operation, assembly and use, are deemed readily apparent and obvious to one skilled in the ability, and all equivalent relationship to those illustrated in the drawings and described in the specification are intended to be encompassed by the present invention.

The above description is to be an illustration only of the principles of the invention. Since numerous modifications and changes will readily occur to those skilled in the trade, it should not be limited to the invention of the exact construction and operation as shown and described. Accordingly, all appropriate modifications and alike may be resorted to, falling within the scope of the invention.

The invention claimed is:

1. A coin operated switch for electrical equipment, said switch comprising:

a coin slot;

a coin channel connected to said coin slot;

a switch member having first and second open electrical circuits;

a first wire element positioned in said coin channel and connected to said first open electrical circuit;

a second wire element positioned in said coin channel and separated from said first wire element by a gap, said second wire element connected to said second open electrical circuit;

wherein when a coin is placed in said coin slot and the passes through said coin channel to contact said first and second wire elements simultaneously, said first wire element closes said first electrical circuit, and said second wire element closes said second electrical circuit to close the switch and operate the electrical equipment.

2. The coin operated switch for electrical equipment of claim 1 wherein said first and second wire elements comprise steel wires.

3. The coin operated switch for electrical equipment of claim 1 wherein said gap is adjustable to accommodate different sized coins.

4. The coin operated switch for electrical equipment of claim 1 wherein said switch member includes two normally closed terminals.

5. The coin operated switch for electrical equipment of claim 1 wherein said switch member includes two normally open terminals.

6. The coin operated switch for electrical equipment of claim 1 wherein said switch member comprises two separate switches.

7. The coin operated switch for electrical equipment of claim 1 wherein said switch further includes a bracket for attachment to existing electrical equipment.

8. The coin operated switch for electrical equipment of claim 7 wherein said bracket comprises a plurality of vertical slots to accommodate different hole patterns.

9. The coin operated switch for electrical equipment of claim 7 wherein said bracket comprises a plurality of horizontal slots to accommodate different hole patterns.

10. The coin operated switch for electrical equipment of claim 7 wherein said bracket comprises a plurality of both vertical and horizontal slots to accommodate different hole patterns.

11. The coin operated switch for electrical equipment of claim 1 wherein the electrical equipment comprises coin operated laundry equipment.

* * * * *